US011268386B2

(12) United States Patent
Benson et al.

(10) Patent No.: US 11,268,386 B2
(45) Date of Patent: Mar. 8, 2022

(54) GAS TURBINE ENGINE HAVING OPTIMIZED FAN

(71) Applicant: ROLLS-ROYCE plc, London (GB)

(72) Inventors: Christopher Benson, Derby (GB); Stephane M M Baralon, Derby (GB)

(73) Assignee: ROLLS-ROYCE plc, London (GB)

( * ) Notice: Subject to any disclaimer, the term of this patent is extended or adjusted under 35 U.S.C. 154(b) by 308 days.

(21) Appl. No.: 16/554,713

(22) Filed: Aug. 29, 2019

(65) Prior Publication Data

US 2020/0072058 A1 Mar. 5, 2020

(30) Foreign Application Priority Data

Sep. 4, 2018 (GB) ..... 1814315

(51) Int. Cl.
*F01D 5/14* (2006.01)
*F01D 5/28* (2006.01)

(52) U.S. Cl.
CPC ..... *F01D 5/141* (2013.01); *F01D 5/282* (2013.01); *F05D 2240/307* (2013.01)

(58) Field of Classification Search
CPC ..... F01D 5/141; F01D 5/282; F05D 2240/307
See application file for complete search history.

(56) References Cited

U.S. PATENT DOCUMENTS 5,299,914 A 4/1994 Schilling
6,071,077 A 6/2000 Rowlands
7,374,403 B2 * 5/2008 Decker ..... F02K 3/06 416/223 R
9,279,328 B2 * 3/2016 Roy ..... B23K 26/24
2006/0228206 A1 10/2006 Decker et al.
2008/0095633 A1 4/2008 Wilson
2009/0165299 A1 7/2009 Cammer
2015/0361824 A1 * 12/2015 Morin ..... F01D 5/02 415/1
2017/0335856 A1 11/2017 Lander et al.
2017/0343011 A1 11/2017 Schwarz et al.
2019/0010807 A1 1/2019 Pouzadoux

FOREIGN PATENT DOCUMENTS

EP 3 205 827 A1 8/2017
WO 2017109408 A1 6/2017

OTHER PUBLICATIONS

Dec. 17, 2019 extended Search Report issued in European Patent Application No. 19194317.4.
Feb. 18, 2021 Office Action issued in European Patent Application No. 19 194 317.4.
Search Report of the Intellectual Property Office of the United Kingdom for GB1814315.6 with search date of Feb. 22, 2019.

* cited by examiner

*Primary Examiner* — Michael L Sehn
(74) *Attorney, Agent, or Firm* — Oliff PLC

(57) ABSTRACT

A gas turbine engine comprises carbon fibre fan blades. At cruise conditions, the fan tip air angle θ in the range: 64 degrees≤θ≤67 degrees. Additionally or alternatively, the fan blade tip angle β is in the range of from 62 to 69 degrees. Arrangements in accordance with the present disclosure provide advantages which may include improved bird-strike performance. This may allow advantages associated with carbon fibre fan blades to be better exploited.

19 Claims, 3 Drawing Sheets

GAS TURBINE ENGINE HAVING OPTIMIZED FAN

CROSS-REFERENCE TO RELATED APPLICATIONS

This specification is based upon and claims the benefit of priority from UK Patent Application Number 1814315.6 filed on 4 Sep. 2018, the entire contents of which are incorporated herein by reference.

BACKGROUND

1. Field of the Disclosure

The present disclosure relates to a gas turbine engine. Aspects of the present disclosure relate to a gas turbine engine having improved efficiency and/or capability to withstand bird strikes.

2. Description of the Related Art

The design of a modern gas turbine engine must balance a number of factors. Such factors include, for example, engine operability and/or stability during operation, engine efficiency (for example optimized efficiency over a typical flight cycle), engine size, and engine weight. A further consideration for a modern gas turbine engine is the capability to withstand bird strikes.

Such bird strikes may occur when the engine ingests one or more birds during operation. Typically, the birds strike the fan blades of the engine. Accordingly, the fan system (including the fan blades and/or fan casing) must be designed to withstand such impact in a manner that enables safe continued operation of the aircraft to which the engine is attached.

The requirement to be able to withstand bird strikes typically compromises other aspect of the engine design. For example, the weight of the fan system (for example the fan blades and/or fan containment case) may be required to increase in order to be sufficiently robust to withstand a bird strike. By way of further example, the design and materials of the fan system (for example the fan blades and/or fan containment case) may be more complex and expensive than would otherwise be required in the absence of the requirement to be able to withstand bird strikes.

SUMMARY

According to an aspect of the present disclosure, there is provided a gas turbine engine for an aircraft comprising an engine core comprising a turbine, a compressor, and a core shaft connecting the turbine to the compressor. The gas turbine engine comprises a fan located upstream of the engine core. The fan comprises a plurality of fan blades. The fan blades comprise a carbon fibre composite material. At engine cruise conditions, a fan tip air angle θ is in the range: 64 degrees≤θ≤67 degrees, the fan tip air angle θ being defined as:

$$\theta = \tan^{-1}\left(\frac{V_{ThetaBladeTip}}{Vx_{air}}\right)$$

-continued where:

$$V_{ThetaBladeTip} = \left|\omega \cdot \frac{D}{2}\right|;$$

ω is fan rotational speed in radians/second;

D is the diameter of the fan in metres at its leading edge; and $Vx_{air}$ is the mean axial velocity of the flow into the fan over the leading edge.

According to an aspect, there is provided a gas turbine engine for an aircraft comprising an engine core comprising a turbine, a compressor, and a core shaft connecting the turbine to the compressor. The gas turbine engine comprises a fan located upstream of the engine core. The fan comprises a plurality of fan blades. The fan blades comprise a carbon fibre composite material. A fan blade tip angle β is defined as the angle between the tangent to the leading edge of the camber line in a cross-section through the fan blade at 90% of the blade span from the root and a projection of the axial direction onto that cross-section, and the fan blade tip angle β is in the range of from 62 to 69 degrees, for example 63 to 68 degrees, for example 64 to 67 degrees, for example 65 to 66 degrees. As used herein, the root may be the radially innermost gas-washed part of the fan blade.

Reference herein to a cross-section through the blade at a given percentage along the blade span (or a given percentage span position)—for example with reference to the fan blade tip angle β—the may mean a section through the aerofoil in a plane defined by: a line that passes through the point on the leading edge that is at that percentage of the span along the leading edge from the leading edge root and points in the direction of the tangent to the circumferential direction at that point on the leading edge; and a point on the trailing edge that is at that same percentage along the trailing edge from the trailing edge root.

The gas turbine engines described and/or claimed herein may combine high foreign object (such as bird) strike capability with low weight. For example providing a fan tip air angle and/or fan blade tip angle in the claimed ranges results in the fan blades being more likely to strike the foreign object (such as one or more birds) with the leading edge of the blade, whereas lower fan tip air angle and/or fan blade tip angles tend to result in the impact being with the face (for example the pressure surface) of the blade. This is advantageous because, due to the plate-like shape of the fan blade, it is naturally stronger (for example less susceptible to deformation and/or damage) when impacted on its leading edge compared with an impact on one of its faces (i.e. one of its suction or pressure surfaces). Thus, the fan blade may be better able to withstand an impact to its leading edge than to an impact of the same magnitude to one of its pressure or suction surfaces. In some cases, the leading edge may be able to slice through the foreign body, causing little or no deformation or damage to the fan blade.

Thus, because the fan blades of gas turbine engines according to the present disclosure are better able to withstand impacts with foreign objects (such as birds), other aspects of the engine may be better optimized. In particular, carbon fibre fan blades may be used, and may be of lighter weight and/or less compromised aerodynamic design than would otherwise be the case. Such carbon fibre fan blades may be particularly susceptible to impact damage. Accordingly, the design of carbon fibre fan blades may typically be compromised—for example in terms of weight and/or aerodynamic efficiency—by the requirement to be able to adequately contend with strikes from foreign objects. Gas turbine engines according to the present disclosure optimise the advantages of carbon fibre fan blades, for example in combining reduced overall fan system weight (including the fan blades and a fan containment system) with optimized aerodynamic design. Thus, the present disclosure may allow greater design freedom over fan blade shape which may, for example, enable a better optimized aerodynamic shape. Purely by way of example, the required thickness of the blade may be reduced, thereby allowing a wider range of designs.

The fan may be directly coupled to at least one turbine stage by a rigid shaft so as to rotate at the same rotational speed as the at least one turbine stage to which it is connected. Thus, gas turbine engines according to the present disclosure may be so-called direct-drive engines. Such engines require the fan to rotate at the same rotational speed as at least one of the turbine stages. An advantage of this is that no gearbox is required between the fan and turbine, thereby reducing complexity, cost and weight.

According to any aspect, the fan blade tip angle β (as defined above) may be within 5 degrees, for example 4 degrees, for example 3 degrees, for example 2 degree, for example 1 degree of the fan tip air angle.

The fan blades may be of any suitable construction. For example, the fan blades may be made of single material, or more than one material.

By way of example, the fan blades may comprise a main body attached to a leading edge sheath. The main body and the leading edge sheath may be formed using different materials. The leading edge sheath material may have better impact resistance than the main body material. This may provide still further improved protection in the event of foreign body impact, such as bird strike, and/or may open up further design freedom (for example in choice of main body material and/or fan blade shape, including thickness). Improved impact resistance may include improved erosion resistance.

Where a leading edge sheath is used, it may be manufactured using any suitable material, such as titanium or a titanium alloy.

Regardless of whether a leading edge sheath is used, the main body of the fan blade may be manufactured using any suitable material, such as material carbon fibre, titanium alloy, or aluminium based alloy (such as aluminium lithium).

In general, a fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A gas turbine engine as described and/or claimed herein may further comprise an intake that extends upstream of the fan blades. An intake length L may be defined as the axial distance between the leading edge of the intake and the leading edge of the tip of the fan blades. The fan diameter D may be defined as the diameter of the fan at the leading edge of the tips of the fan blades. The ratio L/D may be less than 0.5, for example in the range of from 0.2 to 0.45, 0.25 to 0.4 or less than 0.4. Where the intake length varies around the circumference, the intake length L used to determine the ratio of the intake length to the diameter D of the fan may be measured at the $\pi/2$ or $3\pi/2$ positions from top dead centre of the engine (i.e. at the 3 o'clock or 9 o'clock positions), or the average of the intake length at these two positions where they are different.

The gas turbine engine may (or may not) comprise a gearbox that receives an input from the core shaft and outputs drive to the fan so as to drive the fan at a lower rotational speed than the core shaft. The input to such a gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

Where a gearbox is used, it may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

In some arrangements, the fan is not driven via a gearbox, such that the fan is driven directly from a turbine. In such an arrangement the fan rotational speed is the same as the rotational speed of at least one turbine stage.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds). These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm or 390 cm (around 155 inches). The fan diameter may be in an inclusive range bounded by any two of the values in the previous sentence (i.e. the values may form upper or lower bounds).

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 250 cm to 300 cm (for example 250 cm to 280 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 320 cm to 380 cm may be in the range of from 1200 rpm to 2000 rpm, for example in the range of from 1300 rpm to 1800 rpm, for example in the range of from 1400 rpm to 1600 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). In some arrangements, the fan tip loading at cruise conditions may be greater than (or on the order of) any of: 0.2, 0.28, 0.29, 0.3, 0.31, 0.32, 0.33, 0.34, 0.35, 0.36, 0.37, 0.38, 0.39 or 0.4. The fan tip loading may be in an inclusive range bounded by any two of the values in the previous sentence (i.e. the values may form upper or lower bounds).

A quasi-non-dimensional mass flow rate Q for the gas turbine engine is defined as:

$$Q = W\frac{\sqrt{T0}}{P0 \cdot A_{fan}}.$$

where:

W is mass flow rate through the fan in Kg/s;

T0 is average stagnation temperature of the air at the fan face in Kelvin;

P0 is average stagnation pressure of the air at the fan face in Pa;

$A_{fan}$ is the area of the fan face in $m^2$.

At engine cruise conditions the quasi-non-dimensional mass flow rate Q may be in the range of from 0.029 $Kgs^{-1}N^{-1}K^{1/2}$ to 0.036 $Kgs^{-1}N^{-1}K^{1/2}$.

At cruise conditions, the value of Q may be in the range of from: 0.0295 to 0.0335; 0.03 to 0.033; 0.0305 to 0.0325; 0.031 to 0.032 or on the order of 0.031 or 0.032. Thus, it will be appreciated that the value of Q may be in a range having a lower bound of 0.029, 0.0295, 0.03, 0.0305, 0.031, 0.0315 or 0.032 and/or an upper bound of 0.031, 0.0315, 0.032, 0.0325, 0.033, 0.0335, 0.034, 0.0345, 0.035, 0.0355 or 0.036 (all values in this paragraph being in SI units, i.e. $Kgs^{-1}N^{-1}K^{1/2}$).

According to any aspect, the specific thrust (defined as net engine thrust divided by mass flow rate through the engine) at engine cruise conditions may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}$, 80 $Nkg^{-1}s$, 75 $Nkg^{-1}$ or 70 $Nkg^{-1}s$. The specific thrust may be in an inclusive range bounded by any two of the values in the previous sentence (i.e. the values may form upper or lower bounds).

A fan pressure ratio, defined as the ratio of the mean total pressure of the flow at the fan exit to the mean total pressure of the flow at the fan inlet, may be no greater than 1.5 at cruise conditions, for example in the range of from 1.2 to 1.5 or 1.25 to 1.4.

A fan root pressure ratio, defined as the ratio of the mean total pressure of the flow at the fan exit that subsequently flows through the engine core to the mean total pressure of the flow at the fan inlet, may be no greater than 1.25 at cruise conditions. The ratio between the fan root pressure ratio to a fan tip pressure ratio at cruise conditions may be no greater than 0.95, where the fan tip pressure ratio is defined as the ratio of the mean total pressure of the flow at the fan exit that subsequently flows through the bypass duct to the mean total pressure of the flow at the fan inlet.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, or 17. The bypass ratio may be in an inclusive range bounded by any two of the values in the previous sentence (i.e. the values may form upper or lower bounds). The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds).

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). The thrust referred to above may be the maximum net thrust at standard atmospheric conditions at sea level plus 15 deg C (ambient pressure 101.3 kPa, temperature 30 deg C), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds). The maximum TET may occur, for example, at a high thrust condition, for example at a maximum take-off (MTO) condition.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a blisk or a bling. Any suitable method may be used to manufacture such a blisk or bling.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 16, 18, 20, or 22 fan blades.

As used herein, cruise conditions may mean cruise conditions of an aircraft to which the gas turbine engine is attached. Such cruise conditions may be conventionally defined as the conditions at mid-cruise, for example the conditions experienced by the aircraft and/or engine at the midpoint (in terms of time and/or distance) between top of climb and start of decent. For example, the cruise conditions may be defined as the conditions experienced by the aircraft and/or engine at the midpoint (in terms of time and/or distance) between top of initial climb and start of decent for a maximum take-off weight, maximum range aircraft mission. The cruise phase (between the top of the initial climb and start of descent) may itself include a number of altitude "steps", which do not form part of the "initial climb" or "descent". Furthermore, the cruise conditions are defined at steady state operation, and not during any such "step". Where the mid-point between top of climb and start of decent is during such an altitude "step", the cruise conditions may be taken to be at the closest point of steady-state operation in the flight cycle.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be the cruise condition. For some aircraft, the cruise conditions may be outside these ranges, for example below Mach 0.7 or above Mach 0.9.

Purely by way of example, the cruise conditions may correspond to standard atmospheric conditions at an altitude that is in the range of from 10000 m to 15000 m, for example in the range of from 10000 m to 12000 m, for example in the range of from 10400 m or 10500 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to: a forward Mach number of 0.8; a pressure of 23000 Pa; and a temperature of −55 deg C.

As used anywhere herein, "cruise" or "cruise conditions" may mean the aerodynamic design point. Such an aerodynamic design point (or ADP) may correspond to the conditions (comprising, for example, one or more of the Mach Number, environmental conditions and thrust requirement) for which the fan is designed to operate. This may mean, for example, the conditions at which the fan (or gas turbine engine) is designed to have optimum efficiency. The ADP may be any point in the cruise phase of an aircraft to which the gas turbine engine is to be attached, for example the mid-cruise point.

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION OF THE DISCLOSURE

Figure 1:
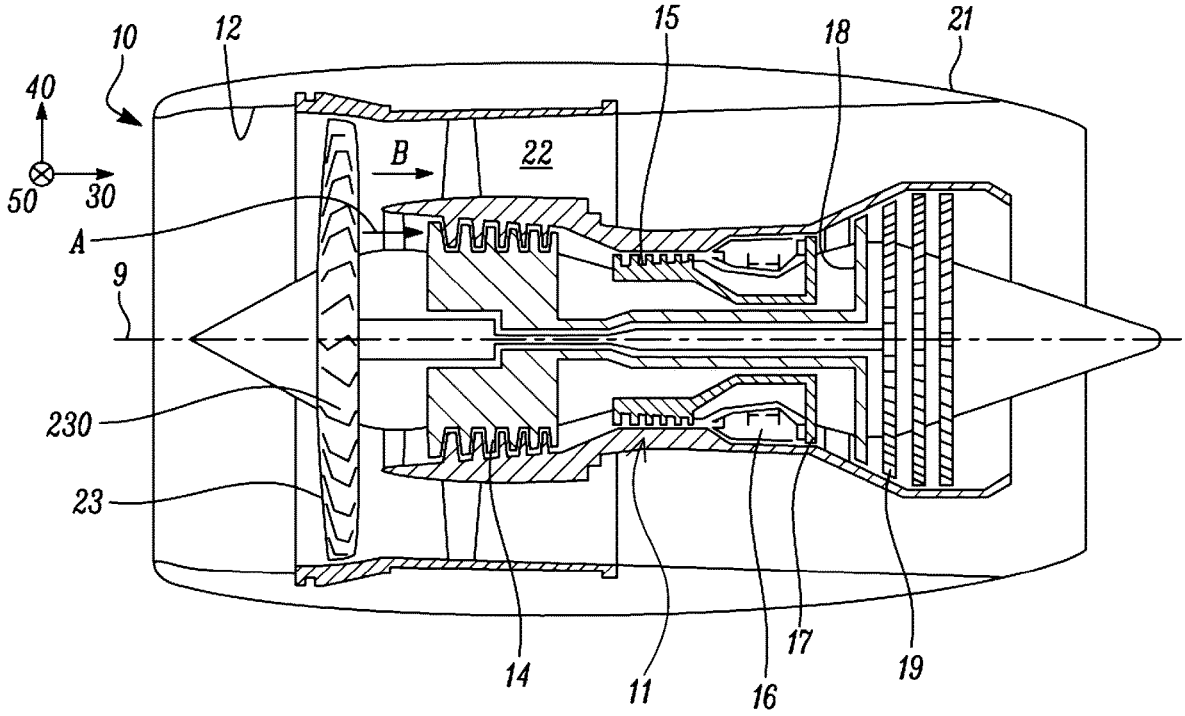
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, an intermediate-pressure turbine 18, and a low-pressure turbine 19. A nacelle 21 surrounds the gas turbine engine 10 and defines a bypass duct 22 and a bypass exhaust nozzle. The bypass airflow B flows through the bypass duct 22.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure, intermediate pressure and low pressure turbines 17, 18, 19 before being exhausted through the nozzle to provide some propulsive thrust. The high pressure turbine 17 drives the high pressure compressor 15 by a suitable interconnecting shaft. The intermediate pressure turbine 18 drives the low pressure compressor 14 by a suitable interconnecting shaft. The low pressure turbine 19 drives the fan 23. The fan 23 generally provides the majority of the propulsive thrust.

Note that the terms "low pressure turbine" and "low pressure compressor" as used herein may be taken to mean the lowest pressure turbine stages and lowest pressure compressor stages (i.e. not including the fan 23) respectively. In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

As noted elsewhere herein, although not shown in the Figures, some arrangements may comprise a gearbox. In such an arrangement, the low pressure turbine may not be present, and the fan 23 may be driven from the intermediate pressure compressor (which may then be the lowest pressure compressor in the engine 10, and thus may be referred to as a low pressure compressor) via a gearbox. Such a gearbox may be an epicyclic gearbox which may be of the planetary type, in that a planet carrier is coupled to an output shaft (which drives the fan 23), with a ring gear fixed. However, any other suitable type of epicyclic gearbox may be used. By way of further example, the epicyclic gearbox may be a star arrangement, in which the planet carrier is held fixed, with the ring (or annulus) gear allowed to rotate. In such an arrangement the fan 23 would be driven by the ring gear. By way of further alternative example, the gearbox may be a differential gearbox in which the ring gear and the planet carrier are both allowed to rotate.

Other gas turbine engines to which the present disclosure may be applied may have alternative configurations. For example, such engines may have an alternative number of compressors and/or turbines and/or an alternative number of interconnecting shafts. For example, in some arrangements, the gas turbine engine 10 may not comprise the intermediate pressure turbine 18, such that the low pressure compressor 14 is driven by the low pressure turbine 19. In such an arrangement (which may be referred to as a "two-shaft" engine, because it only has two interconnecting shafts), the low pressure compressor 14 may be driven by the same shaft—and therefore rotate at the same speed—as the fan 23, and may be referred to in some literature as a "booster" compressor. By way of further example, the gas turbine engine shown in FIG. 1 has a single nozzle, which may be referred to as a mixed flow nozzle, in which the core and bypass nozzles are mixed, or combined, before the exit of the engine. However, alternative configurations may have a split flow nozzle meaning that the flow through the bypass duct has its own nozzle that is separate to and radially outside the core engine nozzle.

One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example.

The geometry of the gas turbine engine 10, and components thereof, is defined by a conventional axis system, comprising an axial direction 30 (which is aligned with the rotational axis 9), a radial direction 40 (in the bottom-to-top direction in FIG. 1), and a circumferential direction 50 (perpendicular to the page in the FIG. 1 view). The axial, radial and circumferential directions are mutually perpendicular.

Figure 2:
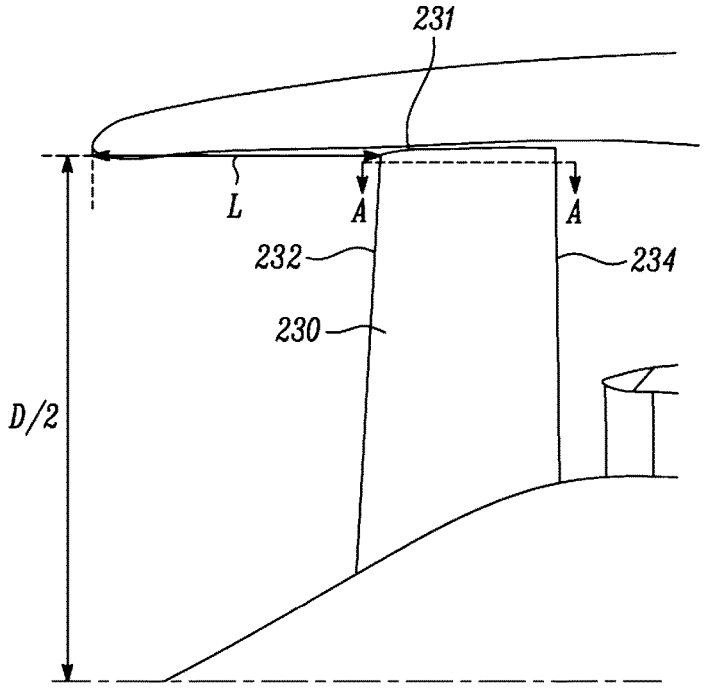
FIG. 2 is a close up sectional side view of an upstream portion of a gas turbine engine.
Figure 3:
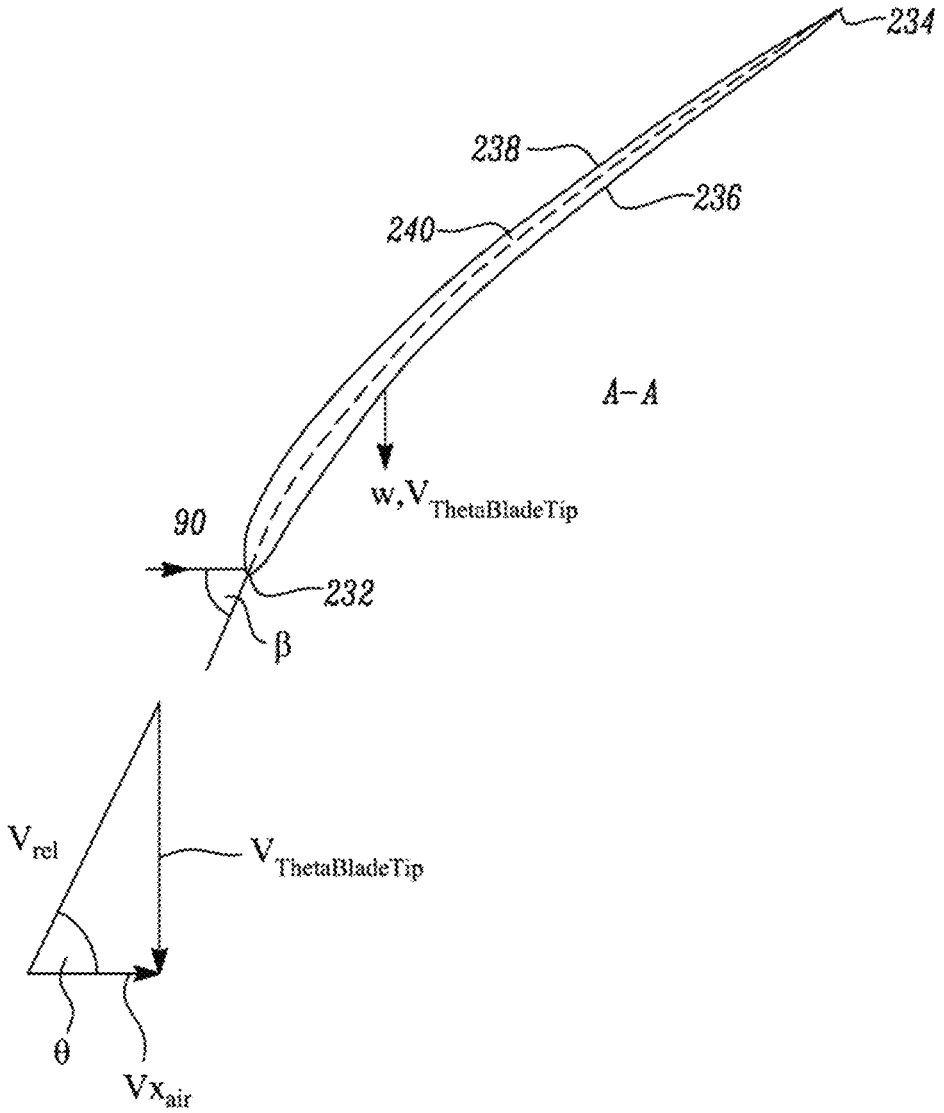
FIG. 3 is a cross-section through the tip region of a fan blade of a gas turbine engine in accordance with the present disclosure.

The fan 23 comprises individual fan blades 230. A cross-section A-A (indicated in FIG. 2) through a tip 231 of one of the fan blades 230 is shown in FIG. 3. The cross-section may be at 90% of the blade span from the root (i.e. from the radially innermost gas-washed part of the fan blade 230).

The fan blade 230 has a tip 231, a leading edge 232, a trailing edge 234, a pressure surface 236 and a suction surface 238. The cross-section A-A also has a camber line 240. The camber line 240 is defined as the line formed by the points in the cross-section that are equidistant from the pressure surface 236 and the suction surface 238 for that cross-section. The cross-section A-A may be as defined elsewhere herein.

A line 90 is a projection into the cross-section A-A of a line that is parallel to the rotational axis 9 of the engine 10. The line 90 passes through the leading edge 232 of the cross-section A-A. The angle between this line 90 and the tangent to the camber line 240 is shown in FIG. 3 as the blade tip angle β. This angle β may be in the ranges defined and/or claimed herein, for example in the range of from 62 to 69 degrees. In the FIG. 3 example, the tangent to the camber line 240 that is used to define the angle β is taken at the very leading edge 232 of the fan blade 23. However, in other arrangements, the tangent to the leading edge of the camber line 240 may be taken at any point within 5% of the total length of the camber line 240 from the leading edge 232. This means that blades having unusual leading edge curvature affecting the forwardmost 5% portion of the blade may still be within the defined ranges blade tip angle β, even if the tangent taken at the very leading edge 232 would not result in an angle β falling within such a range. Purely by way of example, blade tip angle β of the fan blade 230 shown in FIG. 3 is on the order of 65 degrees.

As noted elsewhere herein, in use the fan 23, and thus the fan blades 230, rotate about the rotational axis 9. At cruise conditions (as defined elsewhere herein), the fan rotates at a rotational speed ω, resulting in a linear velocity $V_{ThetaBladeTip}$ at the leading edge 232 of the blade tip 231 given by:

$$V_{ThetaBladeTip} = \left|\omega \cdot \frac{D}{2}\right|$$

At least in part due to the rotation of the fan 230, air is ingested into the fan, resulting in a flow over the leading edge 232. The mean axial velocity of the flow at the leading edge 232 of the fan blade is shown as $Vx_{air}$ in FIG. 3. The vector sum of $Vx_{air}$ and $(-V_{ThetaBladeTip})$ gives the relative velocity $V_{ref}$ of the air at the leading edge 232 of the blade tip 231.

Figure 4:
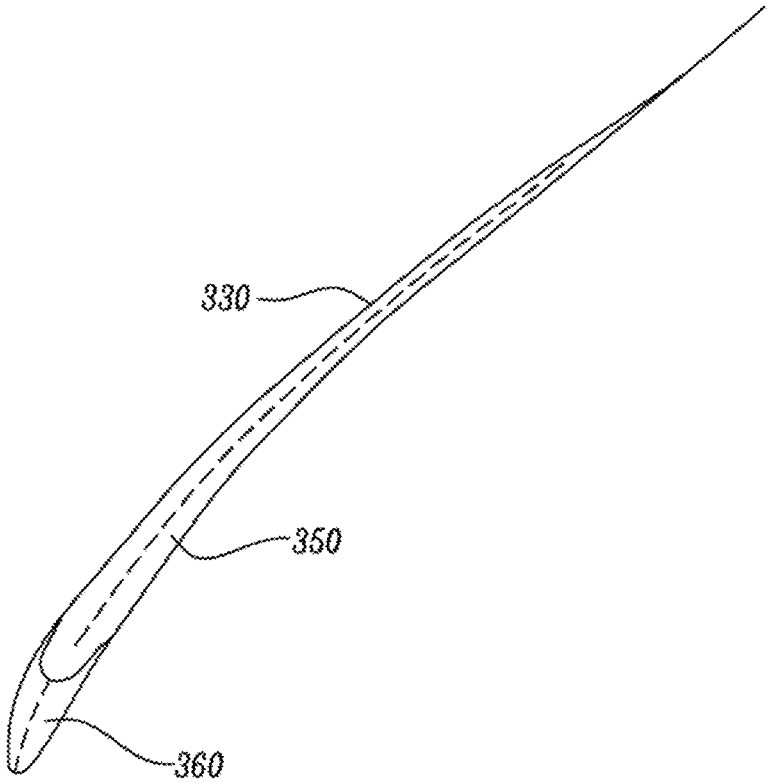
FIG. 4 is a cross-section through the tip region of a fan blade of a gas turbine engine in accordance with the present disclosure.

A fan tip air angle θ is shown in FIG. 4 and defined as:

$$\theta = \tan^{-1}\left(\frac{V_{ThetaBladeTip}}{Vx_{air}}\right)$$

This fan tip air angle θ may be thought of as the angle between the vector representing $Vx_{air}$ (which is in an axial direction) and the vector representing the relative velocity $V_{ref}$ of the air at the leading edge 232 of the blade tip 231.

Gas turbine engines in accordance with some aspects of the present disclosure may have a fan tip air angle θ in the ranges described and/or claimed herein, for example in the range of from 64 degrees to 67 degrees. Purely by way of example, the fan tip air angle θ of the fan blade 230 shown in FIG. 5 is on the order of 65 degrees at cruise conditions of the gas turbine engine 10.

The fan blades 230 may be manufactured using any suitable material or combination of materials, as described elsewhere herein. Purely by way of further example, FIG. 4 shows a fan blade 330 that is the same as the fan blade 230 described above (for example in relation to fan tip air angle θ and blade tip angles β), but has a main body 350 attached to a leading edge sheath 360. The main body 350 and the leading edge 360 in the FIG. 5 example are manufactured using different materials. Purely by way of example, the main body 350 is manufactured using a carbon fibre composite material, and the leading edge sheath 360 may be manufactured from a material that is better able to withstand being struck by a foreign object (such as a bird). Again, purely by way of example, the leading edge sheath may be manufactured using a titanium alloy.

As explained elsewhere herein, gas turbine engines having fan tip air angles θ and/or blade tip angles β in the ranges outlined herein may provide various advantages, such as improving the bird strike capability so as to enable the advantages associated with carbon fibre fan blades to be optimized.

A further example of a feature that may be better optimized for gas turbine engines 10 according to the present disclosure compared with conventional gas turbine engines is the intake region, for example the ratio between the intake length L and the fan diameter D. Referring to FIG. 1, the intake length L is defined as the axial distance between the leading edge of the intake and the leading edge of the tip of the fan blades, and the diameter D of the fan 23 is defined at the leading edge of the fan 23. Gas turbine engines 10 according to the present disclosure, such as that shown by way of example in FIG. 1, may have values of the ratio L/D as defined herein, for example less than or equal to 0.45. This may lead to further advantages, such as installation and/or aerodynamic benefits.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A gas turbine engine for an aircraft comprising:

an engine core comprising a turbine, a compressor, and a core shaft connecting the turbine to the compressor;

a fan located upstream of the engine core, the fan comprising a plurality of fan blades, wherein:

the fan blades comprise a carbon fibre composite material; and at engine cruise conditions, a fan tip air angle θ is in the range: 64 degrees≤θ≤67 degrees, the fan tip air angle θ being defined as:

$$\theta = \tan^{-1}\left(\frac{V_{ThetaBladeTip}}{Vx_{air}}\right)$$

where:

$$V_{ThetaBladeTip} = \left|\omega \cdot \frac{D}{2}\right|;$$

ω is a fan rotational speed in radians/second;

D is a diameter of the fan in metres at a leading edge thereof; and $Vx_{air}$ is a mean axial velocity of a flow into the fan over the leading edge.

2. The gas turbine engine according to claim 1, wherein the fan is directly coupled to at least one turbine stage by a rigid shaft so as to rotate at the same rotational speed as the at least one turbine stage to which it is connected.

3. The gas turbine engine according to claim 1, wherein:

a fan blade tip angle β is defined as an angle between a tangent to a leading edge of a camber line in a cross-section through a fan blade at 90% of a blade span from a root and a projection of an axial direction onto the cross-section, and the fan blade tip angle β is within 2 degrees of the fan tip air angle θ.

4. The gas turbine engine according to claim 1, wherein:

a fan blade tip angle β is defined as an angle between a tangent to a leading edge of a camber line in a cross-section through a fan blade at a tip thereof and an axial direction, the fan blade tip angle β being in the range of from 62 to 69 degrees.

5. The gas turbine engine according to claim 4, wherein the blade tip angle β is in the range of from 63 to 68 degrees.

6. The gas turbine engine according to claim 1, wherein the fan blades comprise a main body attached to a leading edge sheath, a material of the main body and a material of the leading edge sheath being different .

7. The gas turbine engine according to claim 6, wherein the material of the leading edge sheath has better impact resistance than the material of the main body material.

8. The gas turbine engine according to claim 6, wherein the material of the leading edge sheath comprises titanium.

9. The gas turbine engine according to claim 6, wherein the material of the main body comprises the carbon fibre composite material.

10. The gas turbine engine according to claim 1, wherein a specific thrust is defined as net engine thrust divided by mass flow rate through the engine, and at the engine cruise conditions, the specific thrust is in the range of from 70 $Nkg^{-1}s$ to 100 $Nkg^{-1}s$.

11. The gas turbine engine according to claim 1, wherein a quasi-non-dimensional mass flow rate Q is defined as:

$$Q = W\frac{\sqrt{T0}}{P0 \cdot A_{fan}}.$$

where:

W is mass flow rate through the fan in Kg/s;

T0 is average stagnation temperature of air at a fan face in Kelvin;

P0 is average stagnation pressure of the air at the fan face in Pa;

$A_{fan}$ is an area of the fan face in $m^2$, and at the engine cruise conditions:

$$0.029\ Kgs^{-1}N^{-l}K^{1/2} \leq Q \leq 0.036\ Kgs^{-1}N^{-1}K^{1/2},$$

12. The gas turbine engine according to claim 11, wherein the fan rotational speed at the engine cruise conditions is less than 2500 rpm.

13. The gas turbine engine according to claim 1, wherein a fan tip loading is defined as $dH/Utip^2$, where dH is an enthalpy rise across the fan and Utip is a translational velocity of the fan blades at a tip of the leading edge, and at the engine cruise conditions, 0.28 $<dH/Utip^2<0.35$.

14. The gas turbine engine according to claim 1, wherein:

a fan pressure ratio, defined as the ratio of a mean total pressure of a flow at a fan exit to a mean total pressure of a flow at a fan inlet, is no greater than 1.5 at the engine cruise conditions; and/or a fan root pressure ratio, defined as the ratio of a mean total pressure of a flow at the fan exit that subsequently flows through the engine core to the mean total pressure of the flow at the fan inlet, is no greater than 1.25 at the engine cruise conditions, wherein, optionally, the ratio between the fan root pressure ratio to a fan tip pressure ratio at the engine cruise conditions is no greater than 0.95, where the fan tip pressure ratio is defined as the ratio of a mean total pressure of a flow at the fan exit that subsequently flows through a bypass duct to the mean total pressure of the flow at the fan inlet.

15. The gas turbine engine according to claim 1, wherein:

the turbine is a first turbine, the compressor is a first compressor, and the core shaft is a first core shaft;

the engine core further comprises a second turbine, a second compressor, and a second core shaft connecting the second turbine to the second compressor; and the second turbine, the second compressor, and the second core shaft are arranged to rotate at a lower rotational speed than the first core shaft.

16. The gas turbine engine according to claim 1, wherein a forward speed of the gas turbine engine at the cruise conditions is in the range of from a Mach number of 0.75 to a Mach number of 0.85.

17. The gas turbine engine according to claim 1, wherein a forward speed of the gas turbine engine at the cruise conditions is a Mach number of 0.8 and the cruise conditions correspond to atmospheric conditions at an altitude of 11000 m.

18. The gas turbine engine according to claim 1, wherein the cruise conditions correspond to atmospheric conditions at an altitude that is in the range of from 10500 m to 11600 m.

19. The gas turbine engine according to claim 1, wherein the cruise conditions correspond to a forward Mach number of 0.8;

a pressure of 23000 Pa; and a temperature of 55° C.

* * * * *